United States Patent [19]

Shannon

[11] Patent Number: 4,579,460

[45] Date of Patent: Apr. 1, 1986

[54] SYNCHRONOUS WORLD CLOCK

[76] Inventor: Thomas D. Shannon, 3 Crosby St., New York, N.Y. 10013

[21] Appl. No.: 611,737

[22] Filed: May 17, 1984

[51] Int. Cl.[4] ..... G04B 19/22

[52] U.S. Cl. ..... 368/27; 368/23

[58] Field of Search ..... 368/27, 23, 72, 21, 368/22; D10/10

[56] References Cited

U.S. PATENT DOCUMENTS

| | | | |
|---|---|---|---|
| 197,246 | 11/1877 | Cates . | |
| 557,173 | 3/1896 | Thompson | 368/27 |
| 594,410 | 11/1897 | Margolis . | |
| 712,729 | 11/1904 | Schumacher | 368/27 |
| 718,579 | 1/1904 | Phiels | 368/27 |
| 1,344,913 | 6/1920 | Long | 368/27 |
| 1,378,085 | 5/1921 | Balch | 368/27 |
| 1,676,000 | 7/1928 | Whitman . | |
| 1,912,305 | 5/1933 | Phillips . | |
| 2,036,046 | 3/1936 | Harrison | 58/44 |
| 2,056,089 | 9/1936 | Boggs | 58/43 |
| 2,393,676 | 1/1946 | Fuller | 35/46 |
| 2,615,298 | 10/1952 | Ferrari | 368/27 |
| 2,641,898 | 6/1953 | Galley | 58/43 |
| 3,486,322 | 12/1969 | Abend et al. | 58/43 |
| 3,611,704 | 10/1971 | Guintos | 58/44 |
| 4,032,754 | 6/1977 | Ageton | 235/78 R |
| 4,502,789 | 3/1985 | Heath | 368/27 |

FOREIGN PATENT DOCUMENTS

| | | | |
|---|---|---|---|
| 1277600 | 9/1968 | Fed. Rep. of Germany . | |
| 312051 | 10/1933 | Italy . | |
| 95366 | 4/1939 | Sweden . | |
| 2017980 | 10/1979 | United Kingdom | 368/72 |

*Primary Examiner*—Bernard Roskoski

*Attorney, Agent, or Firm*—Morgan, Finnegan, Pine, Foley & Lee

[57] ABSTRACT

A synchronous world clock which allows a user to determine the exact time at any location on earth is disclosed. The clock is comprised of a planisphere of the earth, a time scale surrounding the planisphere and a drive for rotating the planisphere counterclockwise relative to the time scale once every twenty-four hours in synchrony with the rotation of the earth with respect to the sun. The planisphere is a two-dimensional map of the earth which includes an accurate north polar projection of all the earth's inhabited continents. It is divided into a plurality of time zones corresponding to the earth's twenty-four standard time zones. The time zones are marked by a plurality of corresponding time zone indicators equally spaced along the circumference of the planisphere and numbered counterclockwise from 1 to 24. Coinciding with the division of the planisphere, the continents of the map are also divided into twenty-four corresponding conformal time zones which are the twenty-four standard time zones modified according to political boundaries. The time scale is graduated with a series of time marks which cooperate with the circumferential time zone indicators of the planisphere to display the time in their corresponding time zones as the planisphere is rotated relative to the time scale.

22 Claims, 9 Drawing Figures

SYNCHRONOUS WORLD CLOCK

BACKGROUND OF THE INVENTION

The present invention is related to horological instruments, and in particular, to a world clock which displays the exact time of every location on earth simultaneously.

Clocks which are capable of displaying the time at various locations on the earth are known in the prior art. Such clocks are typically designed to allow a user to readily determine the time at various selected locations. Thus, many of these clocks are limited to displaying the time in certain prominent cities and/or selected areas of the earth which are considered to be of greater interest to likely users than other cities and/or areas not encompassed. One major drawback to clocks of this type is that they prevent a user from ascertaining the time in those cities and/or areas of the earth not encompassed by the clock.

Some prior clocks do encompass all the continents of the earth. However, such clocks invariably employ either two faces, one each for the northern and southern hemispheres, or a single face in which the northern and southern hemispheres are superimposed over one another or presented relative to one another in a projection in which large areas of the continents are grossly distorted so as to be at significant variance with the continents as they actually exist. Although such clocks allow a user to ascertain the time at any location on the earth, they can be inconvenient or difficult to use because more than one dial must be observed or because they prevent a user from readily locating a desired location to ascertain the time there due to the distortion in the continents or the confusion caused by the superposition of one set of continents over the other.

Accordingly, one object of the present invention is to provide a simple yet accurate clock which allows a user to readily determine the exact time of any location on earth.

Another object of the present invention is to provide a world clock which continuously displays the exact time in every time zone on earth.

A further object of the present invention is to provide a world clock which displays the exact time in every time zone on earth by means of an accurate planisphere of the earth divided into twenty-four time zones and rotating in synchrony with the earth relative to the sun.

SUMMARY OF THE INVENTION

The present invention is a synchronous world clock which allows a user to readily determine the exact time of any location on earth. The clock is comprised of a planisphere of the earth, a time scale surrounding the planisphere and a drive for rotating the planisphere counterclockwise relative to the time scale once every twenty-four hours in synchrony with the rotation of the earth with respect to the sun.

The planisphere is a two-dimensional map of the earth which includes an accurate north polar projection of all the earth's inhabited continents, although a south polar projection can also be used. Where a south polar projection is used, the planisphere is rotated clockwise relative to the time scale. The planisphere is divided into a plurality of time zones corresponding to the earth's twenty-four standard time zones. A plurality of corresponding time zone indicators, numbered counterclockwise from 1–24, are equally spaced along the circumference of the planisphere. Coinciding with the division of the planisphere into the twenty-four standard time zones, the continents of the map are also divided into 24 corresponding conformal time zones which are the standard time zones modified according to political boundaries.

The time scale is graduated with a series of time marks which extend around the scale, and which cooperate with the circumferential time zone indicators on the planisphere to display the time in the indicators' corresponding time zone as the planisphere rotates relative to the time scale. The time marks represent various time intervals within a twenty-four hour period. Depending on the gradations used, the present invention can display the time in any time zone of the earth with to-the-second accuracy. The time scale is also divided into light and dark sections to provide an indication as to which continents of the earth are experiencing daylight and which are experiencing nightfall at any time of the day.

The planisphere drive is the means by which the planisphere of the earth is rotated counterclockwise in synchrony with the rotation of the earth. The planisphere can be a physically rotating disc or a rotating electronic display. Where the planisphere is a physically rotating disc, the drive is an electromechanical precision device, such as an electric motor and drive gears. Similarly, where the map is an electronic display, the drive is a suitable electronic circuit capable of providing the rotating map display. Because the planisphere drive is a precision device, to-the-second accuracy in time keeping can be achieved with the present invention, even though the planisphere is rotated only once every twenty-four hours.

The present invention also includes two elements which allow a user to highlight his local time and/or the time in other time zones of interest, and to determine whether selected areas of the earth which are of interest are experiencing daylight or nightfall.

The time highlighter can be one or more locator needles, which extend radially from the polar axis center of the planisphere, and which are positionable at selected time zones of interest. Each needle is positioned coincident with the circumferential time zone indicator of any selected time zone, so that it will rotate with such indication and thereby, continuously highlight the time in that zone. The highlighter may also be one or more circle markers surrounding the circumferential time zone indicators.

A day/night background display coextensive with the planisphere provides an indication as to which portions of the earth are experiencing daylight and which are experiencing nightfall at any given time of the day. Where the planisphere is a physically rotating disc, the day/night background display is provided by a dual colored background disc, which is mounted behind and coaxial with the planisphere disc. Where the planisphere is an electronic display, the day/night display is provided by a suitable dual colored electronic display superimposed on the electronic display of the planisphere. The background display is divided into two semicircles, a colored area dark for indicating night, and a light colored area for indicating day. The division between these areas can be sharp or gradual, depending upon the effect that is to be achieved. The background display is also positionable with respect to the time scale so that the times at which daybreak and nightfall occur can be adjusted by season.

THE DRAWINGS

FIG. *6a* shows another alternative embodiment of the present invention, in the form of a wrist watch in which the background disc and time scale are integrated into a single component.

FIG. *6b* shows another wrist watch embodiment of the present invention in which the time scale and background disc are separate components.

FIG. *7a* shows another alternative embodiment of the present invention in the form of a pocket watch utilizing a liquid crystal display for the planisphere.

FIG. *7b* shows the electronic circuit for driving the liquid crystal display of the embodiment of in FIG. *7a*.

DETAILED DESCRIPTION OF THE PREFERRED AND ALTERNATIVE EMBODIMENTS OF THE INVENTION

Figure 1:
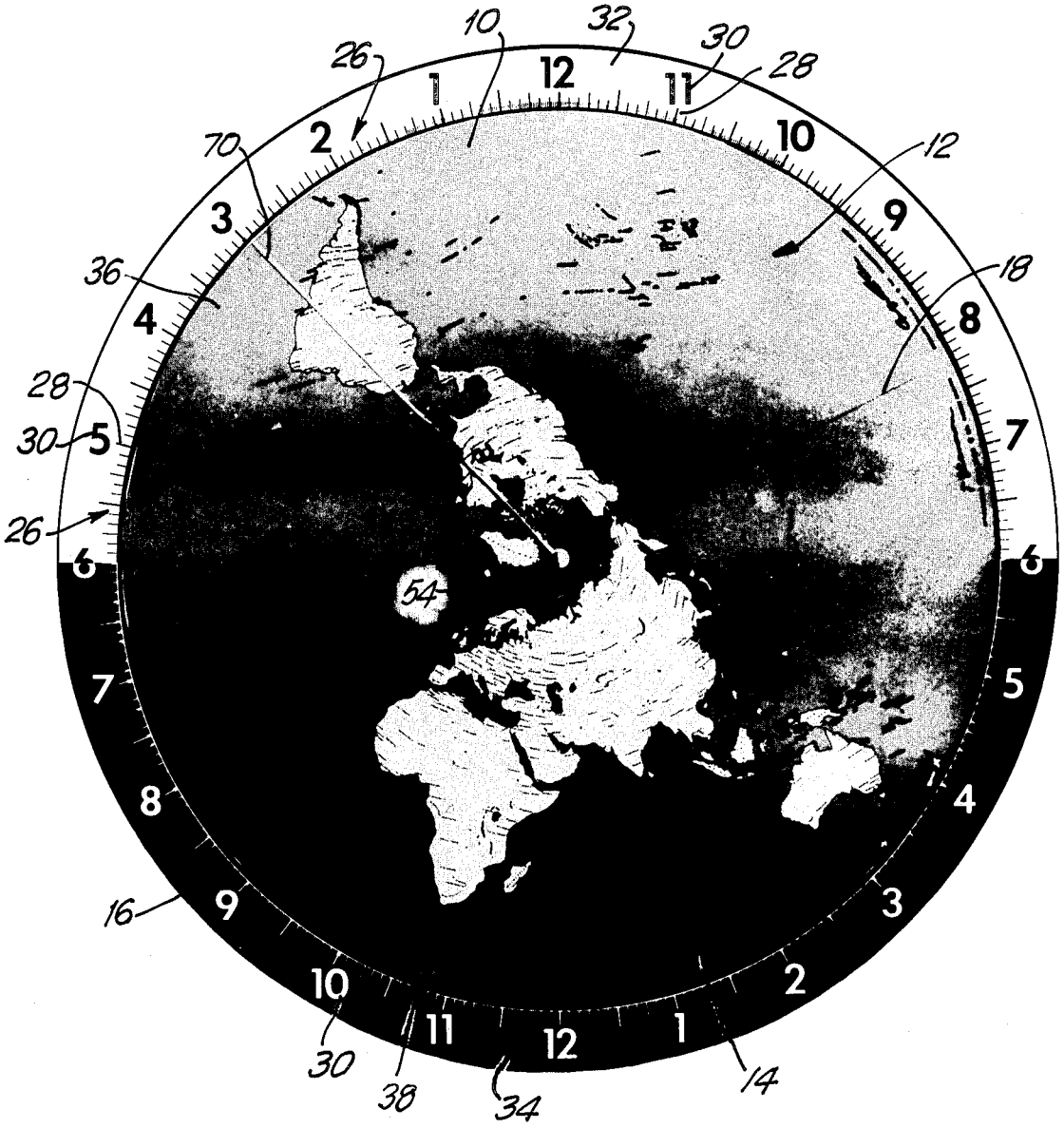
FIG. 1 shows the preferred embodiment of the synchronous world clock of the present invention in which the change from the light to dark areas in the day/night background display is gradual.

FIG. 1 shows the preferred embodiment of the synchronous world clock of the present invention. The main components of the embodiment shown in FIG. 1 are a planet disc 10 with a planisphere 12 of the earth printed thereon, a day/night display background disc 14, coaxial with and mounted behind planet disc 10, a time scale in the form of a time ring 16 encircling the planet and background discs, and a planet drive (not shown) used to rotate the planet disc and planisphere thereon counterclockwise relative to time ring 16 once every twenty-four hours.

The planisphere printed on planet disc 10 is an accurate two-dimensional map of the planet earth which includes an accurate north polar projection of all the earth's inhabited continents. The accuracy of the projection allows a user of the clock to readily locate any area of interest in the world so that he can readily ascertain the time in that area. One example of a projection of this type is the dymaxion map disclosed in U.S. Pat. No. 2,393,676 (the '676 patent). Although a map produced according to the method of projection disclosed in the '676 patent is preferred in practicing the invention, it is to be understood that other types of accurate polar projections may also be used.

Planisphere, or planet map 12 is divided into a plurality of time zones corresponding to the earth's twenty-four standard time zones. The zones are numbered from 1 to 24, beginning with the number 1 at a radially extending line 18 on planet map 12 representing the International Date Line, and proceeding around the map counterclockwise to the number 24. Corresponding numerals 20, numbered 1 to 24 (best seen in FIG. 2), representing each of the time zones, are spaced equally around the circumference of planet disc 10 at 15° intervals.

Figure 2:
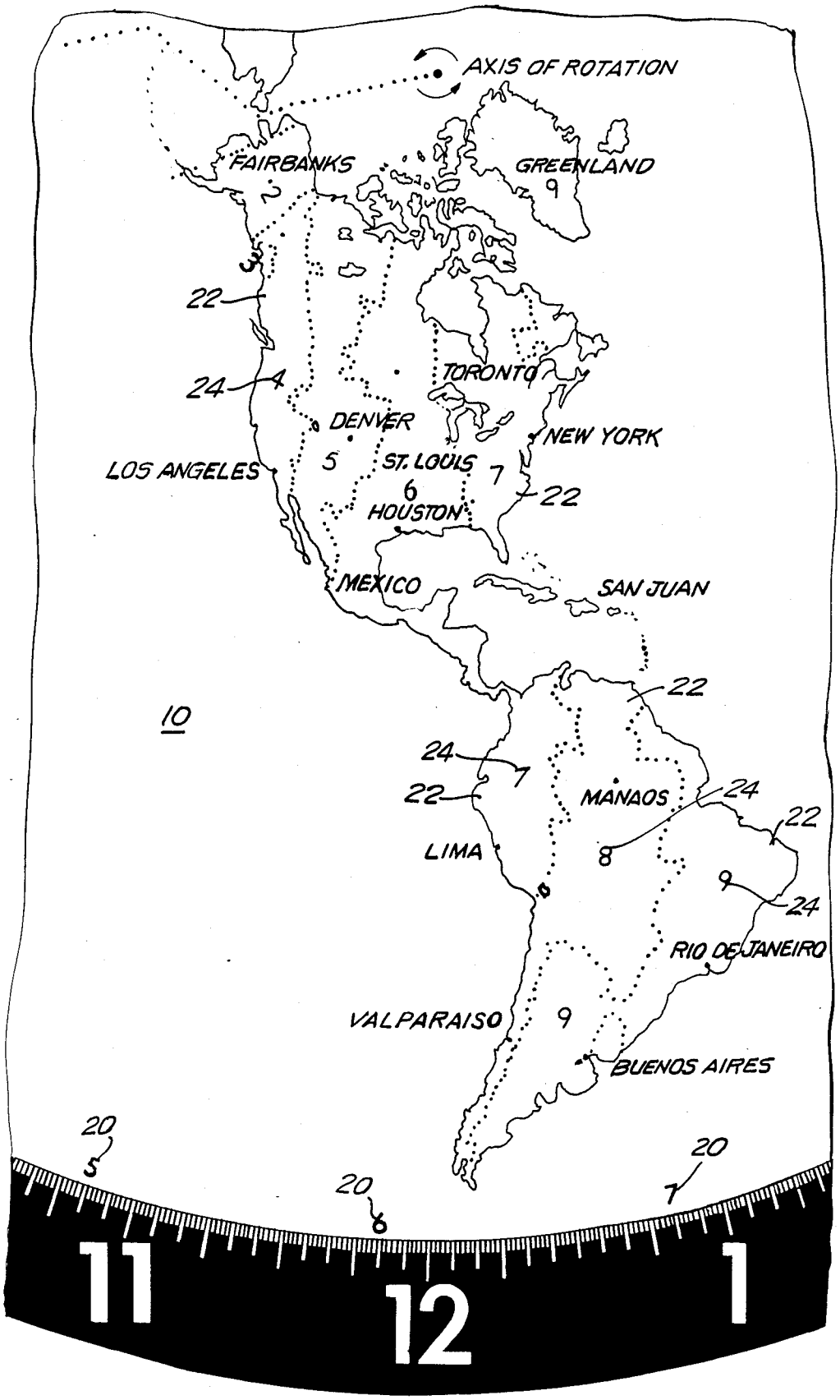
FIG. 2 is an enlarged portion of the map of FIG. 1 showing a portion of the circumferential numerals corresponding to the earth's twenty-four standard time zones and a portion of the conformal time zones into which the continents of the map are divided.

Coinciding with the overall division of planet map 20 into twenty-four time zones, the continents of the map are also divided into twenty-four corresponding conformal time zones 22. These conformal time zones, which are also numbered counterclockwise 1–24 by numerals 24, are the twenty-four standard time zones modified according to political boundaries. Thus, for example, as shown in FIG. 2, the continent of South America is divided into three conformal time zones, numbered 7, 8 and 9 by numerals 24, which correspond to the standard time zones 7, 8 and 9 represented by the identical circumferential numerals 20.

Encircling rotating planet disc 10 is stationary time ring 16. Printed on this time ring is a series of time marks 26 extending completely around it. In the preferred embodiment of the invention, time ring 16 is graduated with 1,440 time marks 26 which correspond to the number of minutes comprising a twenty-four hour period. Included within these marks are 24 large marks 28 corresponding to the twenty-four hours within a single day. Printed next to these hour marks are corresponding hour numerals 30. In the preferred embodiment, these numerals consist of two sets of numerals 1–12, positioned in ascending order counterclockwise. One group of these numerals, spanning the time period from 6:00 A.M. to 6:00 P.M., is printed on a light colored half 32 of time ring 16, while the balance of the numerals, spanning the time period from 6:00 P.M. to 6:00 A.M., are printed on a dark colored half 34 of ring 16. The light colored half of the time ring represents the daylight hours of a given day, while the dark colored half represents the night hours of the same day. For clarity, the minute marks 26, hour mark 28 and hour numerals 30 are printed with a light ink on dark colored half 34 of ring 16, and with a dark colored ink on the light colored half 32 thereof. Although two sets of numerals 1–12 are used in the preferred embodiment of the invention, alternative numbering schemes such as 0–23 or 1–24 may also be used.

Day/night display background disc 14 provides a ready indication as to which portions of the earth are experiencing daylight and which are experiencing nightfall at any time of the day. In the preferred embodiment shown in FIG. 1, day/night background display disc 14, which is typically comprised from either an opaque or translucent material, is colored to include a light portion 36 which gradually darkens into a dark colored portion 38. By gradually changing from a light color to a dark color, disc 14 simulates the effect, as seen from the north pole, of the sun striking half the earth so as to leave the other half in darkness. In the preferred embodiment of FIG. 1 disc 10 is constructed from either a transparent or a translucent material to allow the day/night display of background disc 14 to be seen. Thus, as planet disc 10 rotates counterclockwise, continents passing over dark colored portion 38 of disc 14 appear to be entering night, while those on the opposite side passing over light colored portion 36 appear to be emerging into daylight.

Figure 3:
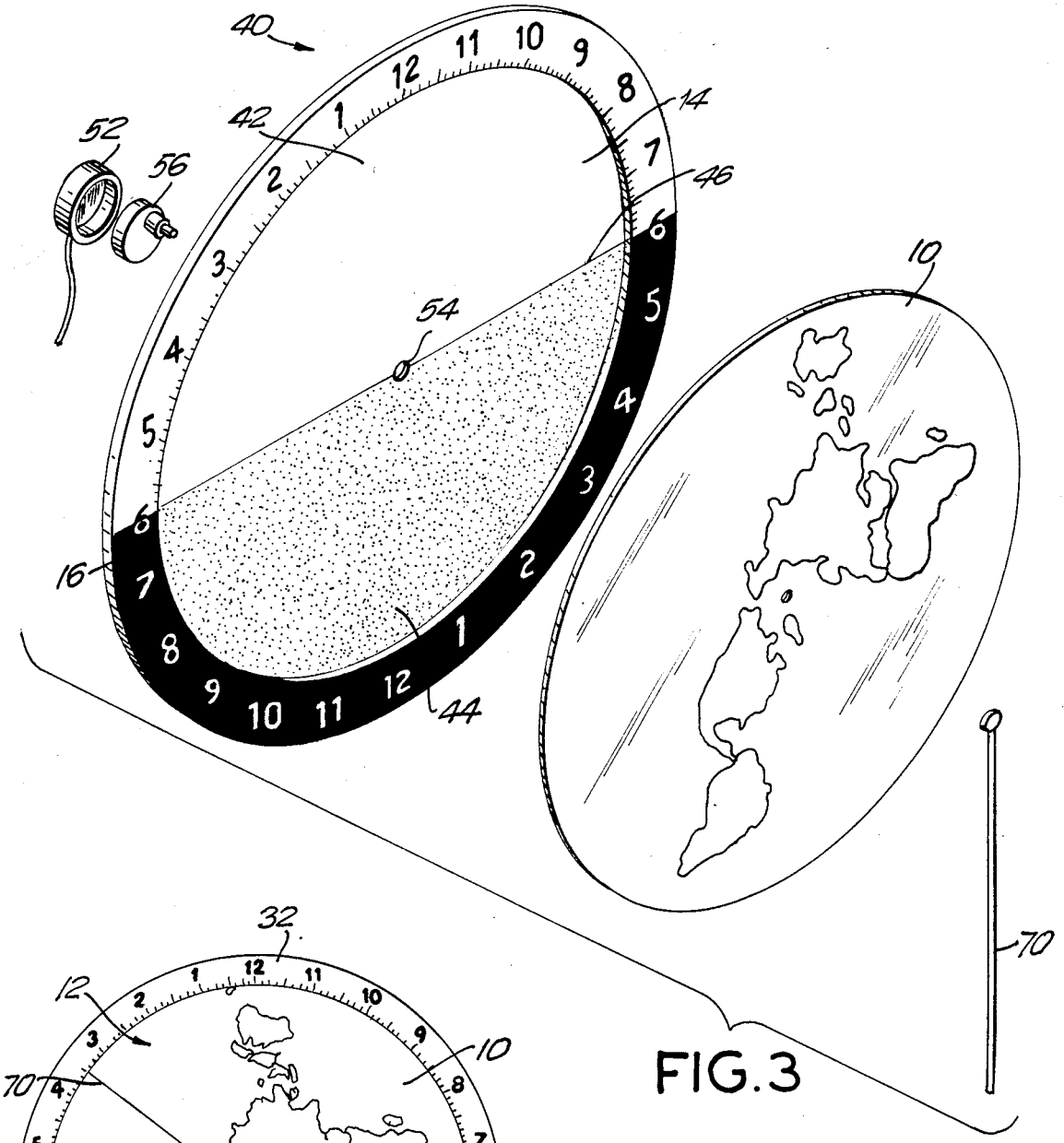
FIG. 3 is an exploded view of an alternative embodiment of the present invention in which the time scale is integral with a day/night display background disc in which the change from light to dark areas is sharp.

As shown in the alternative embodiment of FIG. 3, background disc 14 may be integrally formed with time ring 16 to produce an integral background disc 40 over which planet disc 10 would be mounted. In the embodiment shown in FIG. 3, background portion 14 of disc 40 is formed from an opaque material and divided into a light colored semicircle 42 and a dark colored semicircle 44 separated by a sharp border 46. This arrangement provides a day/night display which changes sharply from day to night to simulate the effect of the sun striking half of the earth.

Figure 5:
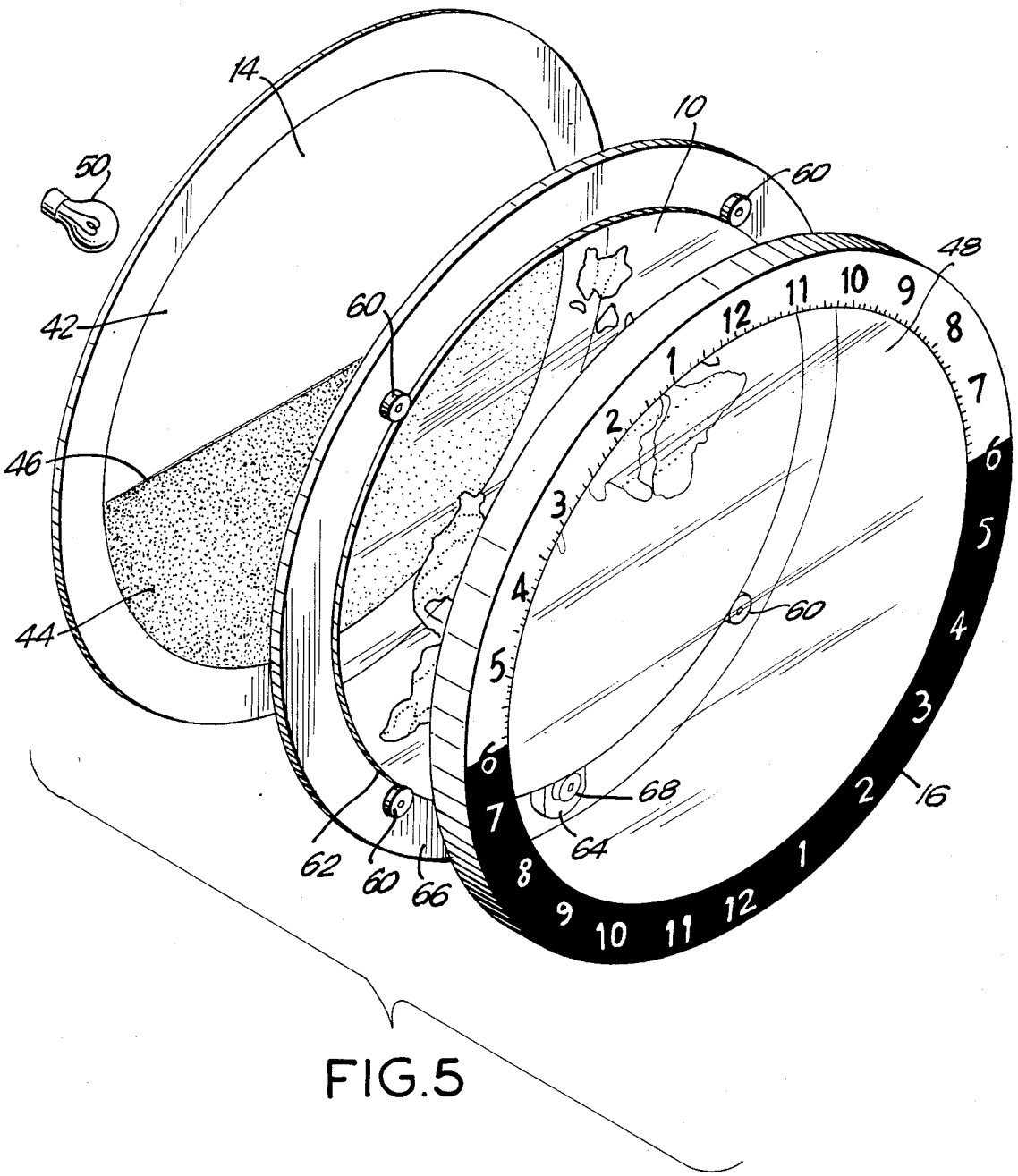
FIG. 5 is another exploded view of a fourth embodiment of the present invention in which the time scale and background disc are separate, and in which a light source is used to illuminate the background and planisphere discs.

As shown in the alternative embodiment of FIG. 5, background disc 14 may be constructed separately from time ring 16 to allow the planet disc to be sandwiched between them. Time ring 14 is then provided with a crystal face 48 mounted therein to protect planet disc 10 from damage. Here again, background disc 14 is divided into a light colored semicircle 42 and a dark colored semicircle 44 to provide a day/night display sharply changing from day to night. However, it is comprised of a translucent material to allow a light source 50 mounted behind it to illuminate both it and planet disc 10. In both the embodiments of FIGS. 3 and 5, planet disc 10 is constructed from a transparent material to allow the day/night display of background disc 14 to be seen.

Figure 4:
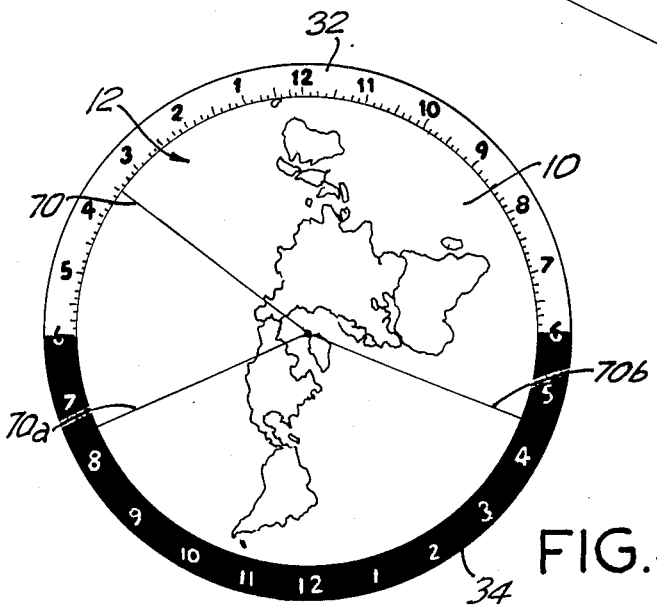
FIG. 4 shows a third alternative embodiment of the present invention utilizing an opaque planet disc and no day/night background display disc.

The world clock of the present invention may also be constructed without a day/night background display. In the embodiment of FIG. 4, planet disc 10 is contructed from an opaque material that is uniform in color except for the printing of map 12 thereon. Here, the effect of the sun strking half of the earth is indicated only by means of the light and dark colored halves 32 and 34 of time ring 16.

The drive used to rotate the planet disc and map counterclockwise once every twenty-four hours may be any one of a number of configurations. In the preferred embodiment of FIG. 1 and the alternative embodiment of FIG. 3, the drive 52 is a counterclockwise rotating one revolution per day (RPD) electric motor of the synchronous type equipped with a one-way clutch for time-setting purposes. As shown in FIG. 3, planet disc 10 is mounted at its center 54 to a shaft 56 of the drive. It should be noted, that other types of one RPD motors such as quartz, electric stepper, etc. may also be used to practice the invention.

Planet disc 10 may also be circumferentially supported on free idler bearings 60, as shown in FIG. 5, to allow it to be driven from its circumferential edge 62. In the embodiment of FIG. 5, a drive motor 64, mounted behind a mounting ring 66, includes a drive wheel or the like interlocked with corresponding drive train elements, such as gear teeth or a pulley 68, which engage the edge 62 of planet disc 10 to rotate it.

A locator needle 70 is also provided in the foregoing embodiments to allow the local time in any selected time zone to be highlighted. As can be seen from FIG. 1, needle 70 extends radially from the center 54 of disc 10 and is rotatable to any position selected on map 12. In operation, however, needle 70 is positioned coincident with the circumferential numeral indicator of a selected time zone to highlight the time in that zone. Thereafter, it is tightened into position so that it rotates with map 12 coincident with the selected indicator. For this purpose, the needle is fixed to planet disc 10, preferably at center 54. Although a single locator needle is shown in the embodiments of FIGS. 1, 3 and 5, it is to be understood that more than one needle may be used as shown by the needles **70*a* and 70*b*** included in the embodiment of FIG. 4.

Figure 6A:
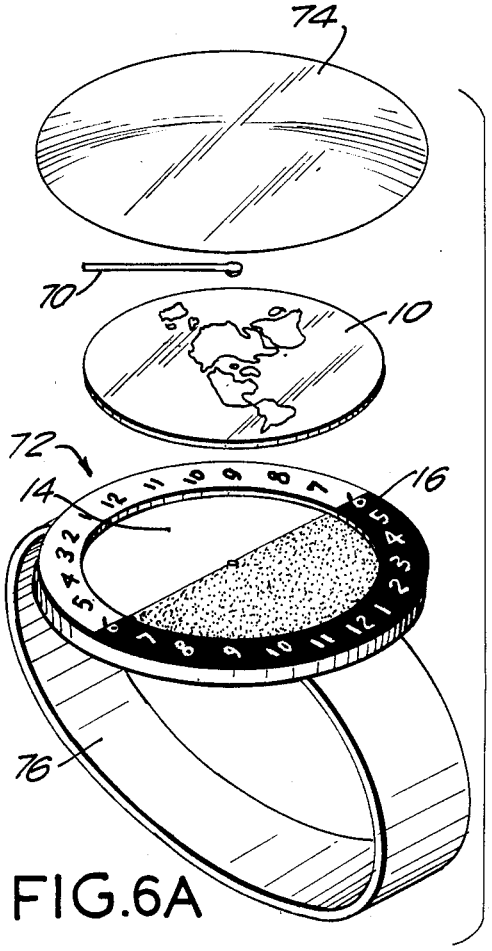
Figure 6B:
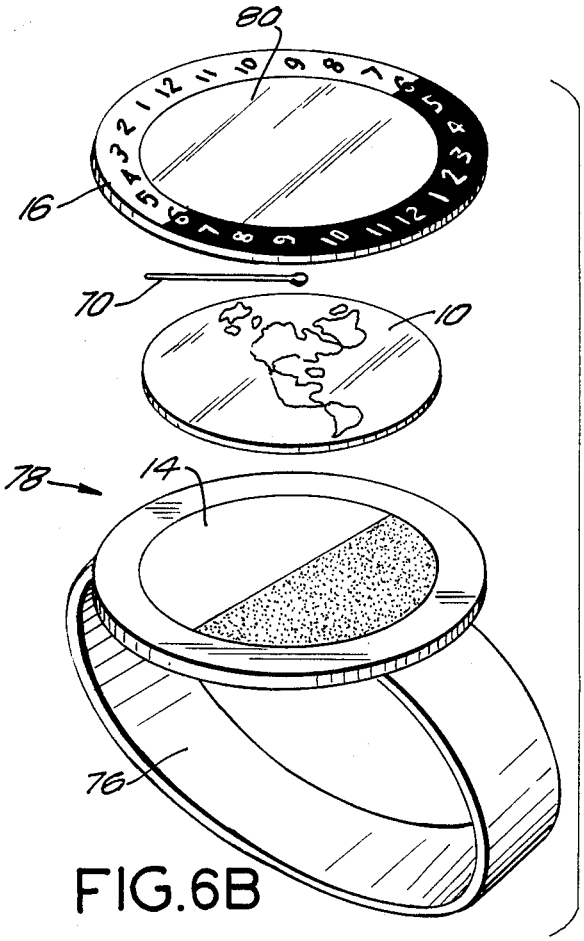

FIGS. 6*a* and 6*b* show two additional embodiments of the present invention in the form of a wrist watch. In the embodiment of FIG. 6*a*, background disc 14 and time ring 16 are integrally formed with a housing 72, containing an electronic controlled stepping motor used to rotate planet disc 10. A crystal face 74, which is affixed to housing 72 to cover and protect planet disc 10, is also provided. The completed assembly is then connected to a wrist band 76 used to hold the watch to the arm of a user.

In the embodiment shown in FIG. 6*b*, only the background disc is formed integrally with a housing 78, also containing an electronically controlled stepping motor for rotating planet disc 10. In this embodiment, time ring 16 is constructed with a crystal face center 80, and is used to cover and protect planet disc 10. Here again, a wrist band 76, attached to housing 78, is provided to hold the wrist watch to the wrist of a user.

Figure 7A:
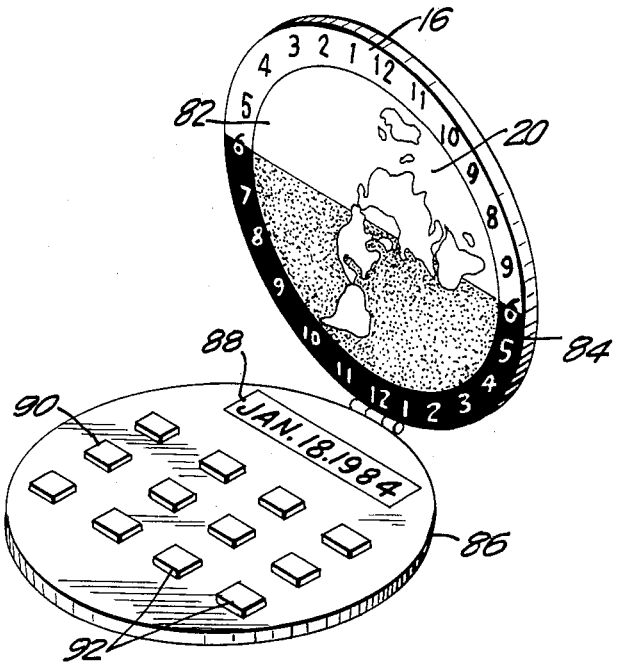

FIG. 7*a* shows a pocket watch embodiment of the present invention which utilizes a liquid crystal display 82 to form the rotating planet or map 20. The embodiment of FIG. 7*a* includes a cover 84, housing display 82 and a time ring 16 encircling the display, hinged to a body 86 housing an additional liquid crystal display 88 providing information such as date and alarm time, and a keypad 90 with a plurality of keys 92 for performing various interactive functions.

Housed within body 86 is the electronic circuitry which generates rotating planet map 12 of display 82 and which performs the various interactive functions selected through keypad 90.

Figure 7B:
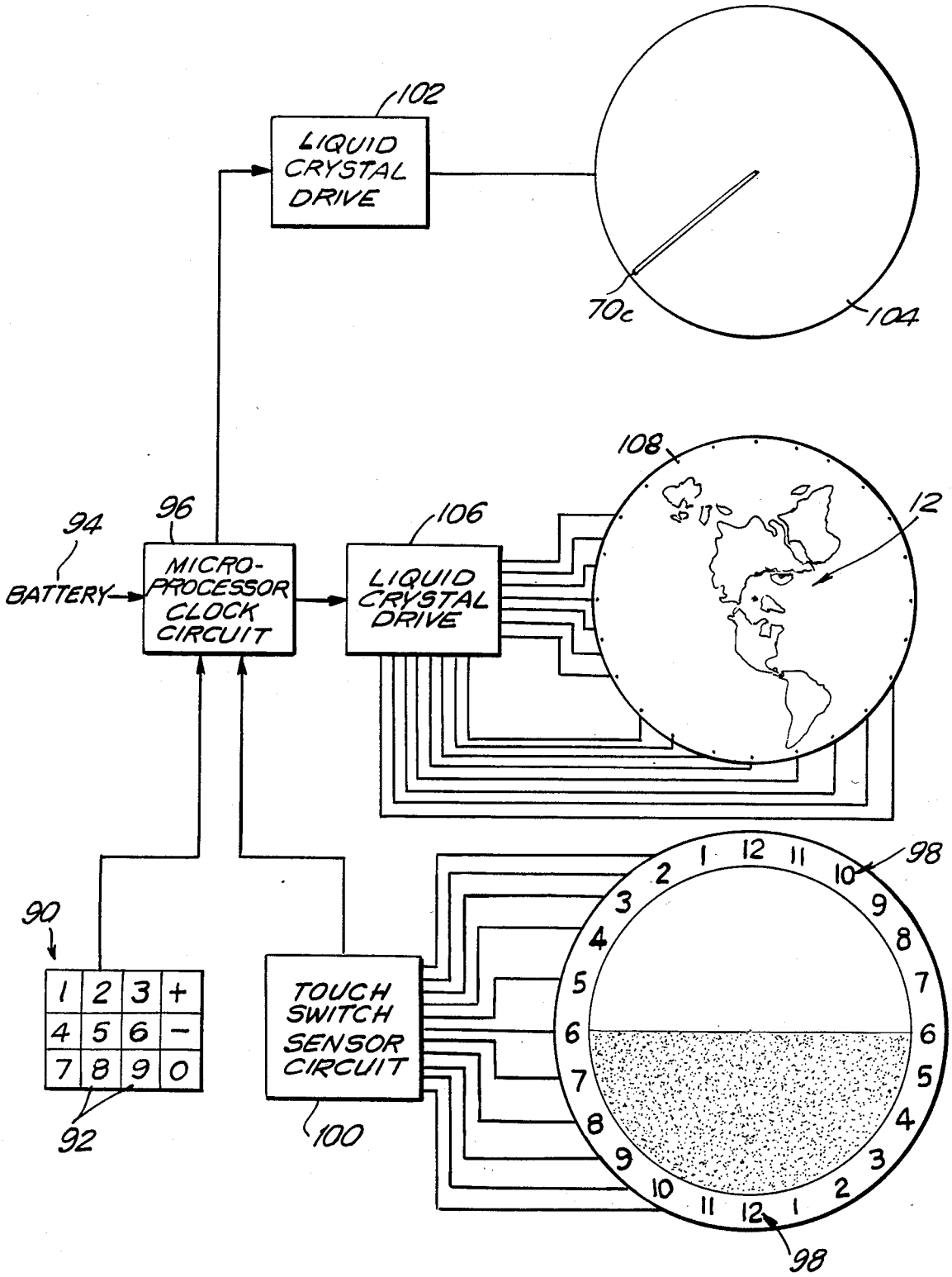

The circuitry housed within body 86 is shown in greater detail in FIG. 7*b*. A battery 94 powers a microprocessor clock circuit 96, which controls the synchronous one revolution per day counterclockwise rotation of planet map 12, as well as such interactive functions as rotating a locator needle image **70*c*** to emphasize a selected time zone, setting an alarm time, setting or displaying a date and making simple mathematical calculations.

These interactive functions are addressed by the various keys 92 of keypad 90 and/or by time ring touch switches 98 through a touch switch sensor circuit 100 connected to microprocessor clock circuit 96. For example, an alarm time can be set by touching the desired hour number touch switch 98 on time ring 16.

A liquid crystal drive circuit 102 provides the necessary voltages to rotate the position of locator needle image **70*c* on a liquid crystal locator's disc 104. Similarly, a second liquid crystal drive circuit 106 provides the necessary voltages to rotate map 12 and manifest such additional information described above on a second liquid crystal disc 108. Disc 104 can either transparently overlay disc 108, or can be combined with disc 108** to form the necessary displays. Similarly, a third liquid crystal disc (not shown) can be used to provide a day/night background display similar to the displays shown in the previously described embodiments of the invention.

The voltages for the various liquid crystal discs are provided initially from data stored in microprocessor clock circuit 96. Located within a read only memory forming a portion of this circuit is the necessary data to create the rotating locator needle image **70*c*, the rotating image of map 12**, and if desired, the day/night background display. Such data can be obtained by empirical means through the use of a series of truth tables emulating the voltages necessary to generate all the displays for an entire twenty-four hour period.

Time is set in the present invention by advancing planisphere 12 until the time-zone numeral of a selected location aligns with the correct local time mark on time ring 16. Thereafter, as the planisphere rotates, all the time-zone numerals on the circumference of planisphere 12 align with the numerals and minute marks of the stationary time ring. Thus, in operation the times for all 24 zones are always automatically displayed.

It is to be understood that a number of variations may be made in the invention without departing from its spirit and scope. The terms and expressions which have been employed in the foregoing descriptions are used in a descriptive and not a limiting sense, and no intention of excluding equivalents of the invention described and claimed is made.

What is claimed is:

1. A world clock comprising:

a single, rotating map encompassing earth's northern and southern hemispheres, said map being a dimensionally accurate polar projection of all of earth's continents and including a plurality of discrete symbols corresponding to earth's twenty-four standard time zones, said continents being divided into a plurality of conformal time zones which are said standard time zones modified according to political boundaries, said conformal time zones being identified by a first portion of said discrete symbols disposed within said conformal time zones, a stationary time scale surrounding said rotating map and cooperating with a second portion of said discrete symbols positioned at predetermined intervals along the circumference of said rotating map so that each of said circumferentially located discrete symbols displays the time within its corresponding time zone, whereby said first and second portions of said discrete symbols in combination allow a user to readily determine the time in any selected time zone, and a drive mechanism rotating said map, and thereby, said discrete symbols, relative to said time scale at least once every twenty-four hours.

2. A world clock as recited in claim 1 wherein said map is a partially non-opaque physical disc and said drive mechanism is an electromechanical drive, the world clock further comprising a second physical disc with mutually exclusive light and dark colored semicircles printed thereon for indicating first and second halves of said map as being in daylight and nightfall, respectively, said second physical disc being mounted behind said partially non-opaque physical disc so that said continents of said map are not obscured by said light and dark semicircles.

3. A world clock as recited in claim 1 wherein said map is an electronic display and said drive mechanism is an electronic circuit generating said display, the world clock further comprising a second electronic display of mutually exclusive light and dark colored semicircles generated by said electronic circuit for indicating first and second halves of said map as being in daylight and nightfall, respectively, said light and dark colored semicircles being mutually exclusive of said continents of said map so that said continents are not obscured by said light and dark semicircles.

4. A world clock as recited in claims 1, 2 or 3 wherein said map is a two-dimensional map of earth that is a north polar projection of all of earth's inhabited continents.

5. A world clock as recited in claim 4 wherein said drive mechanism rotates said map counterclockwise once every twenty-four hours in synchrony with earth's rotation with respect to the sun.

6. A world clock as recited in claims 1, 2 or 3 further comprising at least one single pointer positionable about the circumference of said map for highlighting the time in any selected time zone.

7. A world clock as recited in claim 6 wherein said pointer is a locator needle radially extending from the center of said map.

8. A world clock as recited in claims 1, 2 or 3 wherein said discrete symbols are a plurality of numerals.

9. A world clock as recited in claims 1, 2 or 3 wherein said discrete symbols are a plurality of letters.

10. A world clock comprising:

a single, counterclockwise rotating planet map of earth being a dimensionally accurate north-polar projection of all of earth's continents, said continents being divided into a plurality of conformal time zones which are earth's twenty-four standard time zones modified according to political boundaries, said map including a first plurality of discrete symbols disposed within said conformal time zones identifying said conformal time zones, a stationary time ring encircling said planet map and having a plurality of time marks forming a time scale thereon, said planet map further including a second plurality of discrete symbols representing said standard time zones, said second plurality of discrete symbols being spaced at predetermined intervals along the circumference of said planet map and cooperating with said plurality of time marks of said time ring to display the time in said standard time zones, and a planet drive rotating said planet map, and thereby, said first and second pluralities of discrete symbols counterclockwise relative to said time ring at least once every twenty-four hours so that said discrete symbols continuously display the time in their corresponding time zones, whereby said first and second pluralities of discrete symbols in combination allow a user to readily determine the time in any selected time zone.

11. A world clock as recited in claim 10 wherein said planet map is a partially non-opaque disc and said planet drive is an electromechanical drive, the world clock further comprising a day/night background display coextensive with said planet map, said background display being a second disc with mutually exclusive light and dark colored semicircles printed thereon for indicating which of first and second halves of said planet map are experiencing daylight and nightfall, respectively, without obscuring any portion of said continents in said planet map.

12. A world clock as recited in claim 10 wherein said planet map is an electronic display and said planet drive is an electronic circuit generating said display, the world clock further comprising a day/night background display coextensive with said planet map, said background display being a second electronic display of mutually exclusive light and dark colored semicircles generated by said electronic circuit for indicating which of first and second halves of said planet map are experiencing daylight and nightfall, respectively, without obscuring any portion of said continents in said planet map.

13. A world clock as recited in claim 11 wherein said world clock is a wrist watch.

14. A world clock as recited in claim 12 wherein said world clock is a pocket watch.

15. A world clock as recited in claim 12 wherein said planet map and day/night background electronic displays are liquid crystal displays and wherein said electronic circuit is a microcomputer.

16. A world clock as recited in claims 10, 11 or 12 further comprising at least one single locator needle positionable about said planet map for highlighting the time in at least one selected time zone.

17. A world clock as recited in claim 11 wherein said planet map is transparent so that said day/night background display is distinctly visible.

18. A world clock as recited in claim 11 wherein said planet map is translucent so that said day/night background display is indistinctly visible.

19. A world clock as recited in claim 11 wherein said day/night background display is a physical disc which is colored so that it varies from said light colored semicircle to said dark colored semicircle gradually.

20. A world clock as recited in claim 11 wherein said day/night background display is a physical disc which is colored so that it varies from said light colored semicircle to said dark colored semicircle sharply.

21. A world clock as recited in claims 10, 11 or 12 wherein said discrete symbols are a plurality of numerals.

22. A world clock as recited in claims 7, 8 or 12 wherein said discrete symbols are a plurality of letters.

* * * * *